United States Patent [19]

Ach

[11] 4,011,682

[45] Mar. 15, 1977

[54] TOY BACKDROP DISPLAY FOR SIMULATING ONE OR MORE ROOMS OF A DOLL HOUSE

[75] Inventor: Julie Ann Ach, Long Beach, Calif.

[73] Assignee: Mattel, Inc., Hawthorne, Calif.

[22] Filed: Jan. 14, 1976

[21] Appl. No.: 649,759

[52] U.S. Cl. ..... 46/21; 40/124.1; 160/135; 46/13

[51] Int. Cl.[2] ..... A63H 3/52

[58] Field of Search ..... 46/13, 21; 40/124.1, 40/125 H; 160/135

[56] References Cited

UNITED STATES PATENTS

| | | | |
|---|---|---|---|
| 961,675 | 6/1910 | Bevans | 46/13 |
| 1,045,854 | 12/1912 | Kevitt et al. | 160/135 X |
| 1,443,217 | 1/1923 | Dodd | 46/13 |
| 1,481,333 | 1/1924 | Agar | 40/124.1 X |
| 1,583,775 | 5/1926 | Brandt | 46/13 |
| 2,705,386 | 4/1955 | Bertram | 46/13 |
| 3,463,218 | 8/1969 | Cannon et al. | 160/135 |
| 3,961,426 | 6/1976 | Wallace | 46/13 X |

FOREIGN PATENTS OR APPLICATIONS

| | | | |
|---|---|---|---|
| 678,800 | 1/1964 | Canada | 40/125 H |
| 631,263 | 9/1927 | France | 40/125 H |

*Primary Examiner*—F. Barry Shay
*Attorney, Agent, or Firm*—Robert W. Mulcahy; Stephen L. King; Max E. Shirk

[57] ABSTRACT

A novel structure for an easily assembled and disassembled toy backdrop display for simulating a room or rooms of a house includes at least two wall panels hingedly coupled together along one edge and a plastic beam of U-shaped cross-section having at least first and second pairs of notches spaced from one another for receiving within and holding said first and second wall panels to hold said wall panels at a predetermined corner angle.

3 Claims, 4 Drawing Figures

TOY BACKDROP DISPLAY FOR SIMULATING ONE OR MORE ROOMS OF A DOLL HOUSE

FIELD OF THE INVENTION

This invention relates to an amusement device and, more particularly, to a toy backdrop display for simulating one or more rooms of a house.

BACKGROUND OF THE INVENTION

Children's playthings have long included toys, such as doll houses, and simulated backdrop displays containing decorated walls simulating the rooms and closure members of a normal house as a means of engaging the child's creativity in arranging people and things that occur about him in his household and that of his friends. Of these, there have been some which are made up of cards or panels and which may be folded down to a flat package or packet so that the display may be taken down and put away as well as easily reassembled. By way of example, in the patent literature which has been made known to me, the following by way of background may be of interest to the reader: U.S. Pat. Nos. 984,735, 2,608,026, 2,062,735, 1,583,775, 1,443,217, 2,705,386, and 3,742,642.

OBJECTS OF THE INVENTION

The present invention likewise is directed to and has as an object the provision of a collapsible, storable, and easily assembled backdrop display simulating a room or rooms of a house. It is more particularly an object of the invention to provide an easily assembled and disassembled simulated room backdrop which in its assembled condition is relatively stable, provides a simulated beam ceiling, and which may be assembled substantially only with the walls in a predetermined relationship without the necessity of complex user instructions.

BRIEF SUMMARY

In accordance with the foregoing objects, the invention includes at least two wall panels simulating the walls of a room and suitably containing at least one simulated closure member with these walls being hingedly or otherwise coupled together along one edge to form a corner, the coupling permitting said corner to form any of a plurality of angles, and a beam member constructed of plastic material and of a U-shaped channel cross-section. At least one first pair of notches and a second pair of notches spaced from the first are included in the sides of the beam. The first pair of notches defines an axis inclined to the axis of the beam and the second pair of notches defines an axis similarly inclined to the axis of the beam and intersecting the first axis. The notches receive within and hold the respective first wall portion and the second pair of notches receive within and hold the second wall portion thereby to define a corner angle between the wall portions covered by the axis of the notches and the distance apart between the first and second pair of notches.

In a further aspect of the invention, the plastic beam includes third and fourth sets of similar notches for receiving third and fourth wall panels, which wall panels are similarly hingedly or otherwise coupled together along an edge. And a further aspect of the invention, a fifth wall panel, is hingedly connected to a fourth wall panel, and a second beam of U-shaped cross-section having two spaced pairs of notches is connected between the first and the fifth wall to thereby define a relationship therebetween.

The foregoing objects and advantages of the invention together with the structure characteristic of the invention, as well as additional advantages, becomes more apparent to the reader by giving consideration to the detailed description of a preferred embodiment of the invention which follows, taken together with the figures of the drawings.

DETAILED DESCRIPTION

Figure 1:
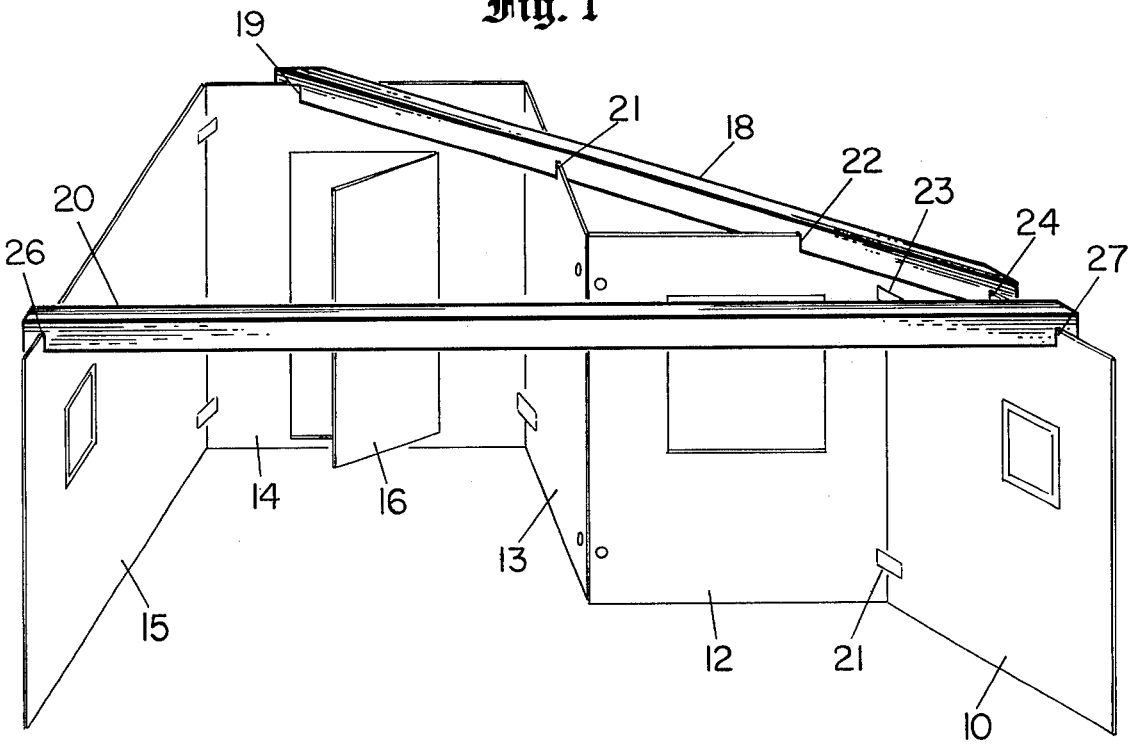
FIG. 1 illustrates an embodiment of the invention.

The embodiment of FIG. 1 includes a series of five walls including a first wall 10, a second wall 12, a third wall 13, a fourth wall 14, and a fifth wall 15. Each of the walls is of a generally rectangular shape and is decorated to simulate the walls of a room or rooms. Thus wall 10 contains a painting as decoration. Wall 12 includes a closure member, such as a window, and wall 14 includes a closure member such as a door 16, shown ajar. Located atop and joining together the walls is a beam 18 and a second beam 20. Walls 10 and 12 are connected together along a vertical edge hingedly by means of a cloth strap 21 and 23. Similarly, walls 13 and 14 are joined together hingedly by means of straps and walls 14 and 15 are joined together by means of a cloth lace. The wall coupling allows the walls, assuming that the beams 18 and 20 are not in place, to be folded flat or to form any corner angle relative to one another. While walls 12 and 13 are not shown joined together, it is within the scope of the invention to similarly have walls 12 and 13 hingedly joined together and the holes for so doing are illustrated.

Figure 2:
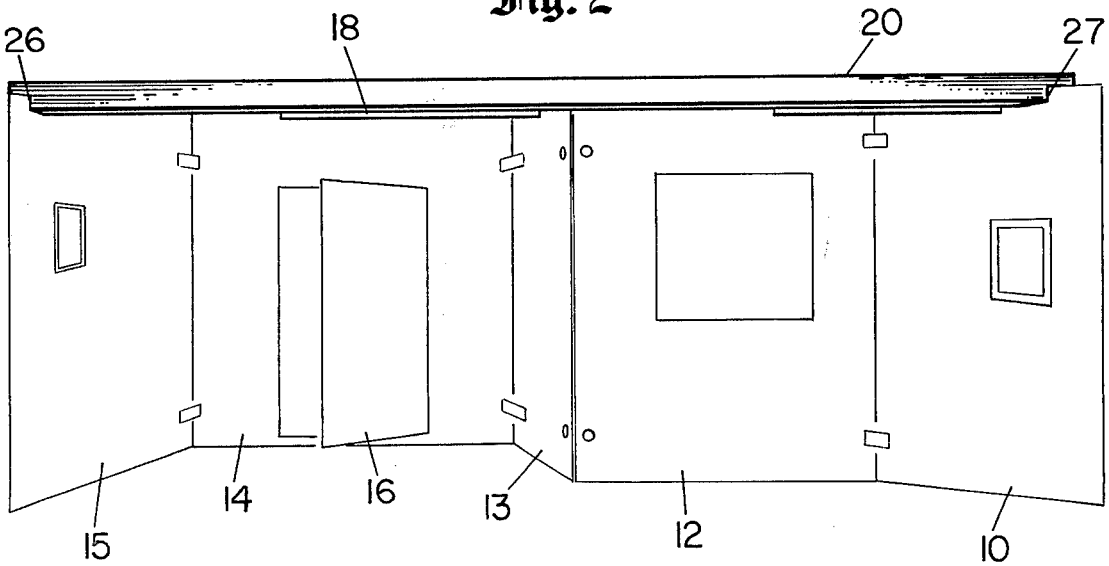
FIG. 2 illustrates the embodiment of FIG. 1 in front perspective.

Reference is made to FIG. 2 which illustrates a front view of the embodiment of FIG. 1 with the elements similarly labeled. As is apparent, the beams create a ceiling or beamed ceiling effect and render the backdrop more attractive.

In FIG. 1, beam 18 includes a series of pairs of slots or notches as is shown at 19, 21, and another notch pair at 24 partly visible in this figure. Similarly, beam 20 contains a notch pair 26 and a notch pair 27.

Figure 3:
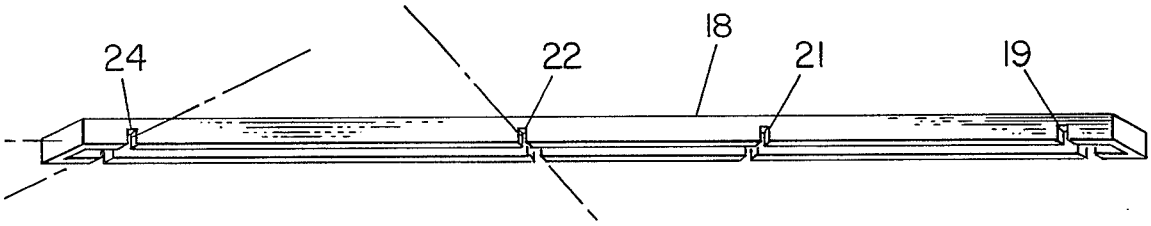
FIG. 3 illustrates the beam element employed in FIG. 1 and in FIG. 4.

As is illustrated more clearly in FIG. 3, the beam 18 is of a plastic material formed by injection molding, having a U-shaped cross-section so as to have two depending sides and a joining side visible in the top view of FIG. 1. Each of the pairs of slots includes a slot on one side and a slot on the opposite dependent side of the beam displaced so as to form a passage having an axis that is at an angle relative to the axis of the beam 18.

By way of example, the axis formed by the pair of slots 22 and the pair of slots 24 are shown and these generally are both at an angle relative to the beam axis and are intersecting. Similarly, the slot pairs 21 and 19 are formed in a predetermined manner to form a predetermined angle.

Reference is again made to FIG. 1 and to FIG. 2. Thus in FIG. 1 the beam 18 is shown having the slots engage, receive therewithin and hold upper portion of wall 14 and an upper portion of wall 13 to maintain these two walls in a predetermined angular relationship and to define the angle of the four corners so formed. Similarly, slot pairs 22 and 27 receive within and hold walls 12 and 10 respectively in a predetermined relationship. Likewise, beam 18 has its slots oriented to form an angle and holds wall 15 in a predetermined angular relationship relative to wall 10. Beam 18 counterbalances the assembly at a location spaced from the formed wall corners. Moreover, it is apparent that the second beam 20 counterbalances the entire assembly and forms a more stable structure with less likelihood that the entire assembly will be accidentally tipped or knocked over.

Figure 4:
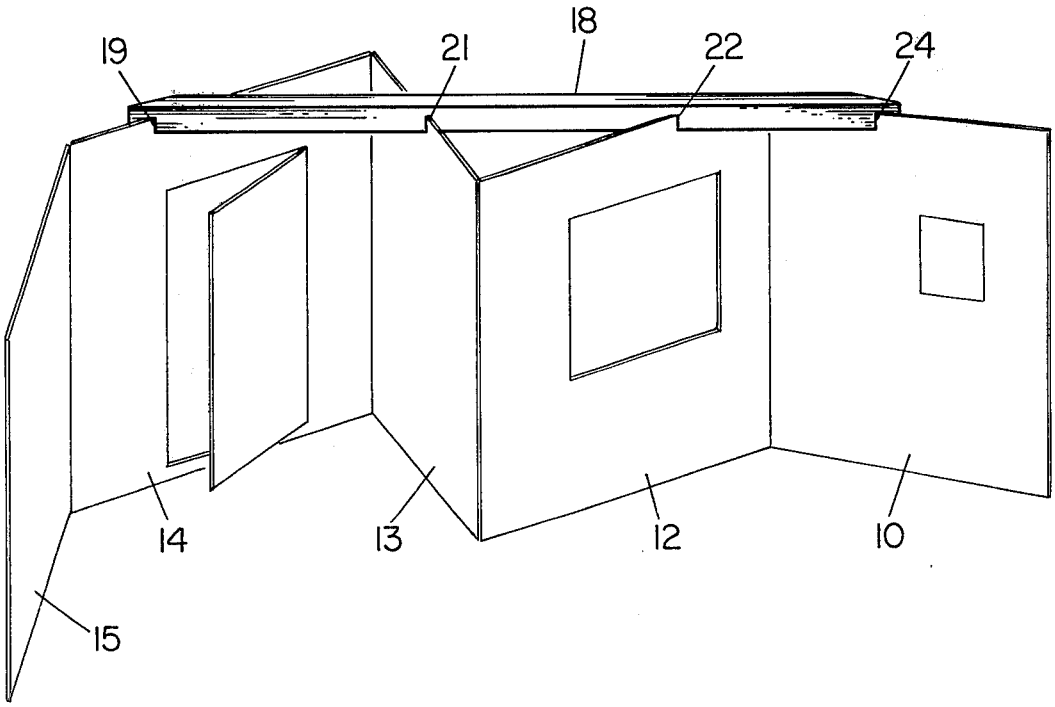
FIG. 4 illustrates a partial embodiment of the invention.

Reference is made to FIG. 4 which may be considered as a second embodiment in which only a single beam 18 is used. For convenience, where the elements have been previously described in connection with the preceding figures, the same elements are identically identified in FIG. 4. Thus slots 22 and 24 in beam 18 defines the relationship of a corner angle between walls 10 and 12 which are hingedly coupled together along one vertical edge. Similarly, slot pairs 19 and 21 define the relationship of the corner angle formed by walls 13 and 14. Indirectly or, if desired, by design the relationship between walls 12 and 13 is also fixed. As a consequence of the slots being spaced apart a distance greater than the thickness of the walls it is apparent that the walls are not permitted to wobble as would be the case were the beam a thin strip with similar slots. Accordingly, the child basically can easily assemble the beams to the walls and is essentially forced to do so in the same position, which by predesigned design is intended so that any child playing this game will reproduce the same scene essentially in the same relationship. Moreover, the injection molded channel member is relatively inexpensive as opposed to a solid member. Thus the toy is more economical to provide. The toy may have its walls taken apart and folded down flat, the beams taken off and put into a box and packaged away for another day without too great of an inconvenience in reassembling the entire display on a subsequent day. The child is not required to review complex instructions since there is only one way in which the parts fit together. Moreover, the unit is well based and is not likely to fall over or blow over.

It is believed that the foregoing description of the preferred embodiments of the invention is sufficient in detail to enable one skilled in the art to make and use same. It is understood, however, that the invention is not to be limited to the details presented for the foregoing purpose, inasmuch as various substitutions and equivalents, as well as improvements, will suggest themselves to one skilled in the art upon reading this specification. Accordingly, it is requested that my invention be broadly construed within the full spirit and scope of the appended claims.

What is claimed is:

1. An easily assembled and disassembled backdrop display for simulating one or more rooms of a house, such as a doll house, comprising, in combination:

at least one pair of relatively flat simulated wall panels, means coupling said panels together about edges thereof for forming a corner, said coupling means permitting said first and second panels to be moved about said coupled edges relative to one another whereby said panels may form a large plurality of corner angles;

a beam, said beam constructed of plastic material and having a U-shaped channel-like cross-section and a predetermined longitudinal axis;

said beam containing;

a first pair of notches, with the notches of said first pair located in opposite sides of said beam and defining a first passage axis therethrough at an angle to said beam axis;

a second pair of notches, with the notches of said second pair located in opposite sides of said beam for defining a second passage axis therethrough inclined to said beam axis and intersecting said first passage axis;

said second pair of notches being spaced a predetermined distance from said first pair of notches;

said first pair of notches being shaped for receiving therewithin and holding said first panel at a predetermined angle and position thereon and said second pair of notches being shaped for receiving therewithin and holding said second panel at a predetermined angle and position thereon;

whereby said beam holds said panels at a predetermined corner angle and increases the stability of said structure by adding weight to said panel edges at a location spaced from said corner and simulates a beamed ceiling; and third and fourth simulated wall panels, means coupling said third and fourth panels together about edges thereof for forming a corner, said latter coupling means permitting said third and fourth panels to be moved about their said coupled edges relative to one another whereby they may form a large plurality of corner angles;

said beam further containing:

a third pair of notches with the notches of said third pair located in opposite sides of said beam to define a third passage axis inclined to said beam axis and a fourth pair of notches, with the notches of said fourth pair located in opposite sides of said beam to define a fourth passage axis inclined to said beam axis and intersecting said third axis, and said third pair of notches being shaped for receiving within and holding said third panel at a predetermined angle and position thereon and said fourth pair of notches being shaped for receiving within and holding said fourth panel at a predetermined angle and position thereon.

2. The invention as defined in claim 1 further comprising means for hingedly coupling together along edges thereof said second wall panel and said third wall panel.

3. The invention as defined in claim 1 further comprising:

a fifth simulated wall panel, means coupling said fifth panel to said fourth panel along edges thereof, said latter coupling means permitting said panels to move relative to one another thereabout;

a second beam having a U-shaped channel-like cross-section and constructed of plastic material and having a predetermined beam axis;

said second beam containing a first pair of notches proximate one end, with the notches thereof located in opposite sides of said second beam, for defining a passage axis inclined to said second beam axis, and a second pair of notches spaced from said latter first pair and located at the other end of said second beam with the notches of said latter second pair located in opposite sides of said beam defining a second passage axis inclined to said second beam axis, said first pair of second beam notches being shaped for receiving within and holding said fifth wall panel and said second pair of second beam notches being shaped for fitting within and further holding said first panel;

whereby said first and second beams form a simulated ceiling to said backdrop of simulated wall panels as viewed in front perspective and whereby a backdrop assembly is formed in a reproducible manner and maintained in a stable upstanding position.

* * * * *